United States Patent [19]

Kulesza et al.

[11] Patent Number: 4,708,690

[45] Date of Patent: Nov. 24, 1987

[54] TOY MECHANICAL MONSTER

[75] Inventors: Ralph J. Kulesza, Chicago; Walter J. Wozniak, Addison; Harry Disko, South Barrington, all of Ill.

[73] Assignee: Marvin Glass & Associates, Chicago, Ill.

[21] Appl. No.: 827,342

[22] Filed: Feb. 7, 1986

[51] Int. Cl.[4] ..... A67H 13/00; A67H 17/00; A67H 13/08

[52] U.S. Cl. ..... 446/351; 446/326; 446/437

[58] Field of Search ..... 446/351, 352, 353, 356, 446/462, 437, 325, 326, 273, 274, 376

[56] References Cited

U.S. PATENT DOCUMENTS

| | | | |
|---|---|---|---|
| 672,707 | 4/1901 | Mackin et al. | 446/274 |
| 907,092 | 12/1908 | Schoenhut | 446/326 |
| 933,623 | 9/1909 | Cecil | 446/273 |
| 1,248,729 | 12/1917 | Seidel | 446/274 |
| 4,471,565 | 9/1984 | Terzian et al. | 446/325 X |
| 4,536,167 | 8/1985 | Hughes | 446/325 X |
| 4,594,071 | 6/1986 | Zaruba et al. | 446/376 X |
| 4,629,440 | 12/1986 | McKittrick, Jr. et al. | 446/356 |

*Primary Examiner*—Philip C. Kannan
*Attorney, Agent, or Firm*—John S. Pacocha

[57] ABSTRACT

A toy mechanical monster has a rounded base that engages a playing surface and houses a motor driving an eccentric weight within the housing. Legs pivotally attached to the housing move to and away from the outside of the housing as it is driven by the eccentric weight increasing the effect of erratic movement of the monster about the playing surface. A head is supported atop the base for rotation by the motor. Pivotally connected to the head are pincer arms with claws that can be used to grasp toy action figures.

18 Claims, 4 Drawing Figures

TOY MECHANICAL MONSTER

BACKGROUND OF THE INVENTION

1. Field of the Invention

This invention relates generally to mechanical toys and more particularly to toy mechanical monsters that interact with toy action figures.

2. Background Art

U.S. Pat. No. 1,248,729 discloses a hollow ball containing a spring wound motor gimbal mounted about an axis parallel to a playing surface to rotate the ball along a playing surface and simultaneously pivot the feet of a figure carried atop the ball. A weight is included to maintain a rod supporting the figure in a generally vertical position. Additional prior art toys including a figure mounted atop an eccentrically weighted ball are found in U.S. Pat. Nos. 672,707; 907,092; and 4,471,565. There remains a need, however, for an entertaining toy mechanical monster that moves about a playing surface on a rounded base in a manner other than is disclosed in these prior art patents.

SUMMARY OF THE INVENTION

The present invention is concerned with providing a toy mechanical monster movable about a playing surface on a rounded base and capable of interacting with toy action figures. These and other objects and advantages of the present invention are achieved with a rounded base that engages a generally planar playing surface and houses a motor driving an eccentric weight about an axis that extends upwardly at an angle to the playing surface. A number of legs are pivotally connected to the housing to pivot toward and away from the housing as the base is driven by the eccentric weight. Mounted above the housing for rotation by the motor is a head that has pivotally connected pincer arms with claws capable of holding a toy action figure.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
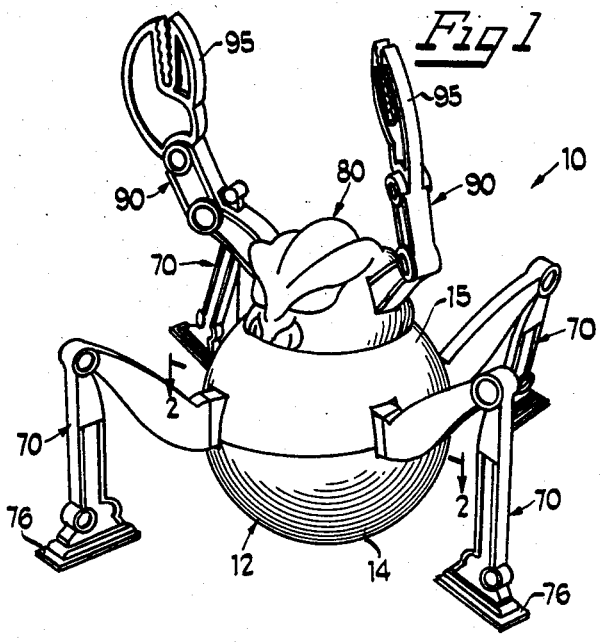
FIG. 1 is a perspective view of an embodiment of the present invention.
Figure 3:
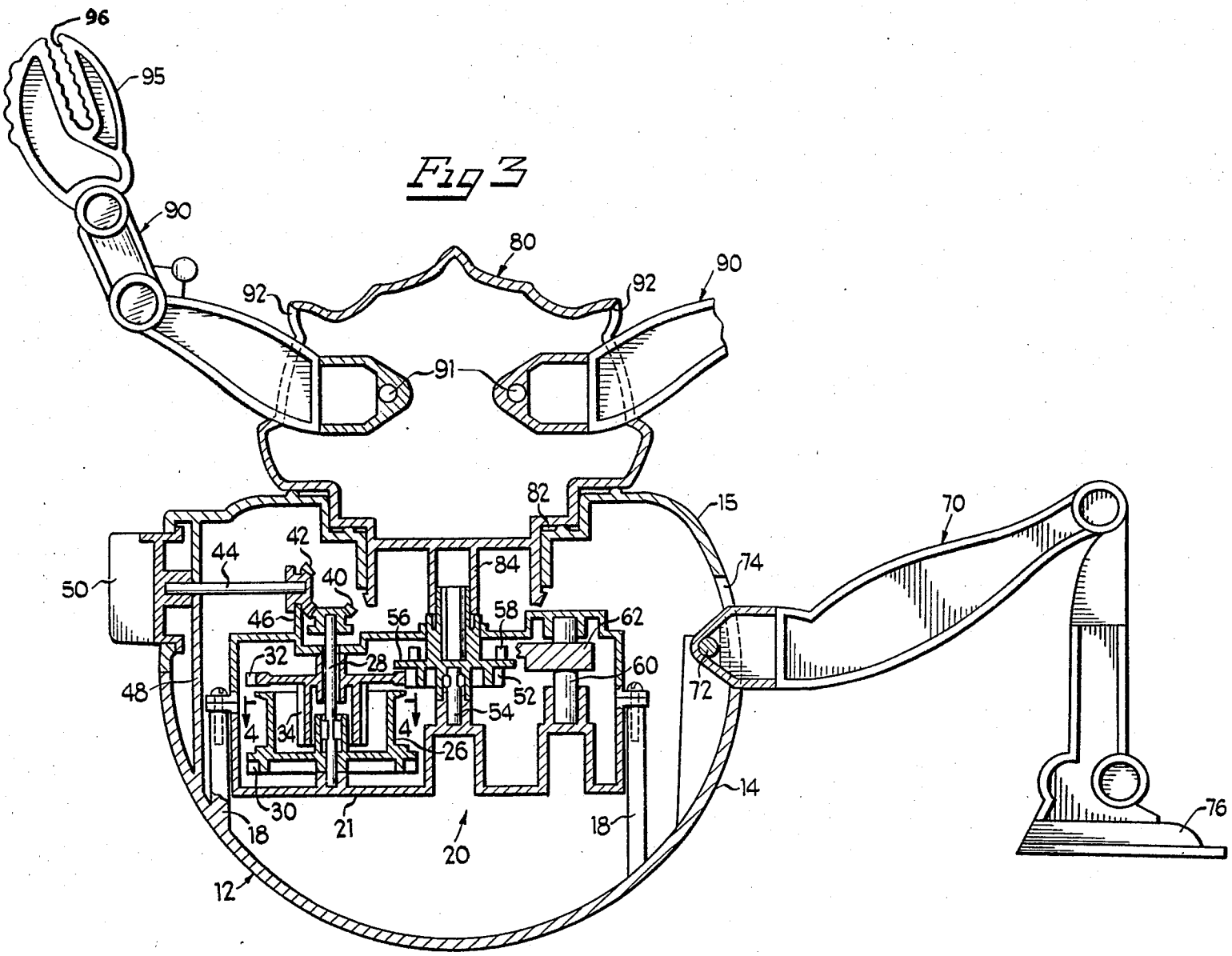
FIG. 3 is a sectional view taken generally along line 3—3 of FIG. 2.

Referring now to the drawings in which like parts are designated by like reference numerals throughout the several views, FIG. 1 shows a toy mechanical monster 10 having a rounded, generally hemispherical base 12. As is best shown in FIG. 3, base 12 is an assembly of a lower, essentially hemispherical portion 14 and an upper cap portion 15 which are attached to each other by ultrasonic welding, suitable adhesives, or other fasteners. Hemispherical portion 14 has a central, upwardly extending axis that is always at one angle, or another, as opposed to being parallel, to a generally planar playing surface. Extending upwardly inside lower portion 14, are motor mounting bosses 18.

An encased negator motor 20 having a case 21 is secured to motor mounting bosses 18 within hollow base housing 12. Motor 20 includes a negator spring 22 that is freely stored about a shaft 24 atop a gear 25 that is fixed on shaft 24 for rotation with the shaft. The other end of negator spring 22 is secured to a drum 26 that is secured to a shaft 28 for rotation with the shaft. Both shaft 24 and shaft 28 are journaled for rotation within case 21 and are substantially parallel to each other. Drum 26 is of a larger diameter than the entire diameter of negator spring 22 stored about shaft 24.

Figure 4:
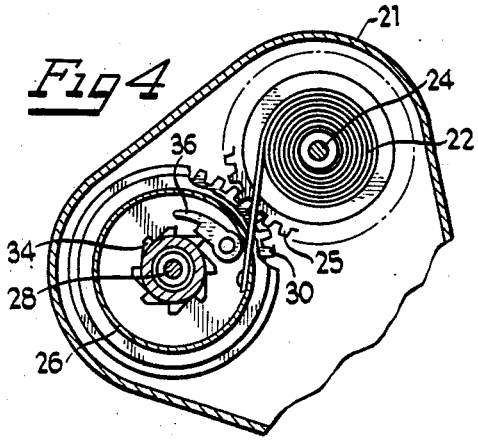
FIG. 4 is a sectional view taken generally along line 4—4 of FIG. 3.

As is best shown in FIG. 3, drum 26 is integrally formed with a lower gear 30. Mounted for rotation on shaft 28, above drum 26, is an upper gear 32 that is integrally formed with a depending ratchet 34. A pawl 36 is pivotally mounted within drum 26, atop the upper face of gear 30. When drum 26 is wound in the clockwise direction, as illustrated in FIG. 4, to wind negator spring 22 about drum 26, pawl 36 merely rotates with gear 30 around ratchet 34. However, when the negator spring 22 winds itself back about shaft 24, pawl 36 engages the ratchet to drive gear 32. Lower gears 25 and 30 engage during winding and unwinding of the spring to regulate to the speed of rotation.

At the top of shaft 28, a bevel gear 40 is secured for rotation with the shaft. Gear 40 engages a bevel gear 42 mounted for rotation on a shaft 44 that is substantially transverse to shaft 48. Gear 42 is supported for rotation in a flange 46 extending upwardly from the motor case. Shaft 44 is journaled in an aperture extending through an internal wall 48 and extends out through a larger opening in the cap 15. Attached to the extended end of shaft 44 for rotation with the shaft is a winding knob 50. When the knob is rotated in a clockwise direction as a person faces the knob, bevel gear 42 rotates bevel gear 40 which winds the negator spring 22 about drum 26. Because drum 26 is of a larger diameter than the diameter of the stored negator spring about shaft 24, after a predetermined limited length of negator spring 22 is wound about drum 26, the remainder of negator of spring 22 about shaft 24 will bind and hence restrict any further unwinding of the negator spring from around shaft 24.

Figure 2:
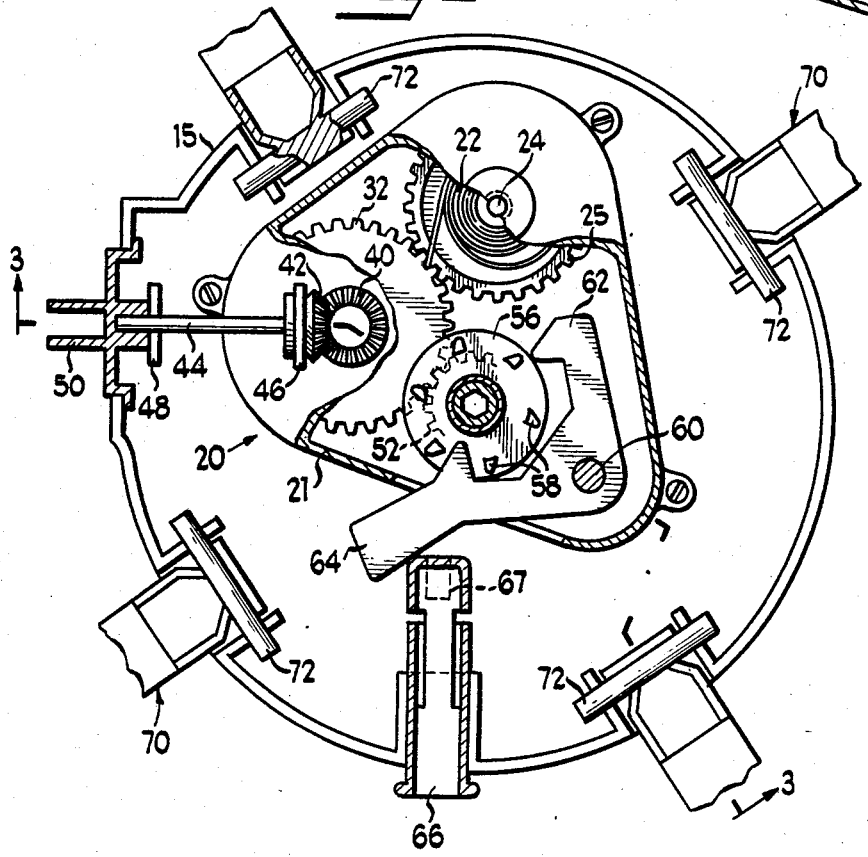
FIG. 2 is an enlarged sectional view taken generally along line 2—2 of FIG. 1.

Upper gear 32 engages a gear 52 mounted for rotation about a shaft 54. Integrally formed atop gear 52 is a disc 56 with six spaced apart upstanding teeth 58. Mounted for pivotal movement about a shaft 60, in a plane generally parallel with the plane of disc 56, is an escapement 62 with an offset weight 64. The axis of shaft 54 is substantially the central axis of hemispherical portion 14. Under the drive of the rewinding negator spring, teeth 58 periodically engage the escapement 62 to oscillate the offset weight 64 causing rounded base 12 to move about a generally planar playing surface in a wobbling, erratic manner. Extending out one side of the base is a push/pull actuator 66. When pushed in, as illustrated in FIG. 2, actuator 66 blocks the offset weight 64 from moving and hence stops the entire motor. Actuator 66 has a detent 67 adjacent the inside end to prevent the actuator being pulled all the way out of base housing 12.

Four legs 70, spaced approximately ninety degrees around the periphery of base 12, are each mounted for pivotal movement about a respective pin 72. The axes of pins 72 all lie in a plane which is substantially transverse to the axes of generally parallel shafts 24, 28, 54 and 60. An opening 74 in base housing 12 permits limited pivotal movement of each leg about its respective pin. Remote from the connected end, each leg has a foot 76.

With the central axis of base 12 oriented substantially vertical with respect to a playing surface, the vertical distance from the axis of pin 72 to the bottom of foot 76 is less for each leg than the distance between the axis of the pin and the playing surface.

Atop base 12, there is a head 80 that is received in a generally central, stepped recess 82 formed in the top of cap portion 15 of the base housing. Head 80 has a generally central, depending portion 84 in engagement with the upper part of gear 52 so that the head is rotated by motor 20. Approximately one hundred eighty degrees apart, two pincer arms 90 are mounted for pivotal movement with respect to the head about a respective pin 91. The axes of pins 91 lie in a plane generally parallel to the plane in which the axes of pins 72 lie. Openings 92 in the sides of head 80 permit limited, generally up and down, pivotal movement of the pincer arms. At the free end of each pincer, a claw 95 is formed with an opening 96 defined by facing serrated surfaces. The claws 95 are formed of a material sufficiently resilient to permit the forcing of an arm or leg of a toy action figure into the claw.

After the motor is wound and released, the oscillation of offset weight 64 will cause the toy 10 to wobble about its rounded base on a substantially parallel playing surface. From time to time, a foot 76 of one of the pivotally mounted legs engages the playing surface causing a further change in the direction of movement of the erratically wobbling monster. Securing a toy figure within one or both of the pincer claws pivotally carried by the rotating head further enhances the entertaining effect of the erratic movement of the monster and provides additional play.

While a particular embodiment of the present invention has been shown and described, changes and modifications will occur to those skilled in the art. It is intended in the appended claims to cover all such changes and modifications as fall within the true spirit and scope of the present invention.

What is claimed as new and desired to be secured by Letters Patent is:

1. A toy mechanical monster comprising:
a base housing having a rounded bottom;
motor means mounted within the housing;
the housing having a generally upstanding central axis at an angle to a generally planar playing surface on which the rounded bottom base is supported;
a weight mounted for movement about an axis spaced from the generally central axis;
the motor means driving the weight for eccentric movement to effect movement of the rounded base about the playing surface;
a leg carried by the base housing and extending substantially outside of the housing;
the leg having a free end; and
the free end of the leg being spaced from the playing surface when the generally central axis is substantially vertical.

2. The toy mechanical monster of claim 1 in which the leg is mounted for pivotal movement with respect to the housing about an axis transverse to the generally central axis.

3. The toy mechanical monster of claim 2 including a mumber of the pivotally mounted legs, each leg being pivotal about an axis lying in a common plane and each leg being spaced from the playing surface when the generally central axis is substantially vertical.

4. The toy mechanical monster of claim 1 including an upper member carried by the base housing for rotation with respect to the base housing.

5. The toy mechanical monster of claim 4 in which the upper member is carried for rotation around the generally central axis.

6. A toy mechanical monster comprising:
a base housing having a rounded bottom;
motor means mounted within the housing;
the housing having a generally upstanding central axis at an angle to a generally planar playing surface on which the rounded bottom base is supported;
a weight mounted for movement about an axis spaced from the generally central axis;
the motor means driving the weight for eccentric movement to effect movement of the rounded base about the playing surface;
an upper member carried by the base housing for rotation with respect to the base housing; and
the motor means rotatably driveing the upper member.

7. The toy mechanical monster of claim 6 including:
a leg carried by the base housing and extending substantially outside of the housing;
the leg having a free end; and
the free end of the leg being spaced from the playing surface when the generally central axis is substantially vertical.

8. The toy mechanical monster of claim 6 in which the upper member has arms substantially extending outside of the upper member and mounted for pivotal movement with respect to the member.

9. The toy mechanical monster of claim 8 in which the arms are mounted for pivotal movement about an axis generally transverse to the axis of rotation of the head.

10. The toy mechanical monster of claim 8 in which the arms are mounted for pivotal movement about an axis substantially transverse to the generally central axis.

11. The toy mechanical monster of claim 8 in which the end of each arm opposite the pivotal connection includes a claw.

12. The toy mechanical monster of claim 11 in which the claw has a slot that may be used to grasp a part of a toy action figure.

13. A toy mechanical monster comprising:
a base housing having a rounded bottom;
motor means mounted within the housing;
the housing having a generally upstanding central axis at an angle to a generally planar playing surface on which the rounded bottom base is supported;
a weight mounted for movement about an axis spaced from the generally central axis;
the motor means driving the weight for eccentric movement to effect movement of the rounded base about the playing surface;
an upper member carried by the base housing for rotation with respect to the base housing; and
the upper member having arms substantially extending outside of the upper member and mounted for pivotal movement with respect to the member.

14. The toy mechanical monster of claim 13 including:
a leg carried by the base housing and extending substantially outside of the housing;

the leg having a free end; and the free end of the leg being spaced from the playing surface when the generally central axis is substantially vertical.

15. The toy mechanical monster of claim 13 in which the arms are mounted for pivotal movement about an axis generally transverse to the axis of rotation of the head.

16. The toy mechanical monster of claim 13 in which the arms are mounted for pivotal movement about an axis substantially transverse to the generally central axis.

17. The toy mechanical monster of claim 13 in which the end of each arm opposite the pivotal connection includes a claw.

18. The toy mechanical monster of claim 17 in which the claw has a slot that may be used to grasp a part of a toy action figure.

* * * * *